US012781994B2

(12) United States Patent
Mathis et al.

(10) Patent No.: US 12,781,994 B2
(45) Date of Patent: Nov. 3, 2026

(54) DEVICE FOR SETTING AN AIR VOLUMETRIC FLOW RATE

(71) Applicant: VIESSMANN CLIMATE SOLUTIONS SE, Allendorf (DE)

(72) Inventors: Paul Mathis, Düren (DE); Dirk Müller, Aachen (DE)

(73) Assignee: VIESSMANN CLIMATE SOLUTIONS SE, Allendorf (DE)

( * ) Notice: Subject to any disclaimer, the term of this patent is extended or adjusted under 35 U.S.C. 154(b) by 554 days.

(21) Appl. No.: 18/036,084

(22) PCT Filed: Nov. 2, 2021

(86) PCT No.: PCT/EP2021/080364
§ 371 (c)(1),
(2) Date: May 9, 2023

(87) PCT Pub. No.: WO2022/101056
PCT Pub. Date: May 19, 2022

(65) Prior Publication Data

US 2024/0019163 A1 Jan. 18, 2024

(30) Foreign Application Priority Data

Nov. 13, 2020 (EP) ..... 20207397

(51) Int. Cl.
*F24F 13/062* (2006.01)
*F24F 13/10* (2006.01)
*F24F 13/24* (2006.01)

(52) U.S. Cl.
CPC ..... *F24F 13/062* (2013.01); *F24F 13/105* (2013.01); *F24F 13/24* (2013.01)

(58) Field of Classification Search
CPC ..... F24F 13/062; F24F 13/105; F24F 13/24; F24F 13/065; F24F 13/10; F24F 13/142
(Continued)

(56) References Cited

U.S. PATENT DOCUMENTS 5,340,358 A 8/1994 Halupczok et al.
2018/0119970 A1 5/2018 Vogel
2020/0248925 A1* 8/2020 Minor ..... F24F 13/105

FOREIGN PATENT DOCUMENTS

AU 6278994 A 9/1994
DE 1 698 046 A1 11/1971
(Continued)

OTHER PUBLICATIONS

International Search Report for PCT/EP2021/080364 dated, Jan. 20, 2022 (PCT/ISA/210).

*Primary Examiner* — Steven B McAllister
*Assistant Examiner* — Charles R Brawner
(74) *Attorney, Agent, or Firm* — Sughrue Mion, PLLC

(57) ABSTRACT

A device for adjusting a constant air volume flow has air guiding members which extend in a radial direction and in a state distributed about a longitudinal center axis of the device. Between adjacent air guiding members there are formed air passages which can be adjusted in terms of their opening cross section. The air guiding members are formed from a first and a second air guiding unit in each case. By rotating the first air guiding unit relative to the second air guiding unit, the opening cross section of the air passages can be changed. The air guiding units are constructed in such a manner that the air guiding member formed thereby has a closed and curved surface at least at the inflow side. This enables a change of the free flow cross section, wherein the location of the narrowest flow cross section is consistent at different adjustment positions.

30 Claims, 7 Drawing Sheets

(58) Field of Classification Search
USPC ..... 454/284
See application file for complete search history.

(56) References Cited

FOREIGN PATENT DOCUMENTS

| | | | | |
|---|---|---|---|---|
| DE | 103 21 518 | A1 | 3/2004 | |
| DE | 202011000453 | U1 * | 5/2011 | ..... F01P 7/10 |
| EP | 0 414 022 | B1 | 2/1994 | |
| EP | 2 783 166 | B1 | 4/2018 | |
| GB | 190320981 | A | 7/1904 | |
| GB | 1 436 838 | A | 5/1976 | |

* cited by examiner

DEVICE FOR SETTING AN AIR VOLUMETRIC FLOW RATE

CROSS REFERENCE TO RELATED APPLICATIONS

This application is a National Stage of International Application No. PCT/EP2021/080364 filed Nov. 2, 2021, claiming priority based on European Patent Application No. 20 207 397.9 filed Nov. 13, 2020.

TECHNICAL FIELD

The present invention relates to a device for setting an air volume flow, in particular in an air distribution network.

PRIOR ART

Air distribution networks are in particular used in buildings for aeration and ventilation and partially for air-conditioning the spaces in use. Controlled housing and office ventilation systems are nowadays well-developed systems which use centralized or decentralized ventilation devices.

The wall, ceiling or floor openings of a building have air passages with inserts which are connected to the air distribution network. Such air passages change the shape of the air flow and/or they control the air volume flow. In the air distribution network itself, inserts are also sometimes provided in order to adjust or regulate the air volume flow.

There are known inserts, the through-openings of which cannot be changed. Other inserts enable the adjustment of the air volume flow. Inserts which regulate the air volume flow are generally referred to as air volumetric flow controllers, air volume throttles or air volume throttle valves. They limit the cross section in the ventilation pipe, wherein this limitation can be selected.

The inserts have depending on the embodiment flaps, blades or iris diaphragms. Examples of this are disclosed in US 2018/0119970 A1 and DE 10321518 A1.

DE 1 698 046 A1 discloses a throughput controller for aeration devices of living rooms. The controller has two wings in the form of circular ring segments, in order to partially close a passage and radially protruding blades which are arranged in a circular manner. The axial spacing of the blades with respect to the circular ring segments is intended to be used to separate turbulence fields.

EP 0 414 022 B1 describes a swirl passageway of an air duct system having two sheet metal plates which are arranged one above the other with punched-out guide vanes. By rotating the two sheet metal plates, the opening cross section can be changed.

U.S. Pat. No. 5,340,358 A sets out an air passage with air guiding elements in the form of radial swirl impellers and having a baffle plate which delimits an annular outlet cross section. The air guiding elements can be vertically adjusted in a stepless manner. Depending on the selected position, the air jets are discharged in another form and at a different angle.

EP 2 783 166 B1 discloses a device for adjusting the air throughflow quantity within an air pipe having a tubular member and a ring which can be rotated about the longitudinal axis of the body. The device further has a plurality of flaps which when the ring is rotated can be rotated about an axis perpendicular to the longitudinal axis in order to change the air passage cross section.

The optimum adjustment of the air volume flow is generally left to technical experts since the smallest mechanical changes of the air flow volume controller can have many effects. Thus, when the position of the flap or the blades is changed, not only is the air volume flow changed, but significant turbulences are also produced in the flow. Iris apertures and also flaps or blades tend to produce disruptive whistling noises. Furthermore, the current air volume flow controllers are very sensitive to a disrupted incident flow, as occurs, for example, after a curve or a branch. Furthermore, they generally only function in one flow direction and lose their function when they are flowed through in the opposite direction.

STATEMENT OF INVENTION

An object of the invention is therefore to provide a device for adjusting an air volume flow, in particular in an air distribution network, which has the most consistent control behavior possible.

The device according to the invention for adjusting an air volume flow, in particular in an air distribution network, has air guiding members which extend in a radial direction and in a state distributed about a longitudinal center axis of the device. Between adjacent air guiding members there are formed air passages which can be adjusted in terms of their opening cross section. At least some of the air guiding members are formed from a first and a second air guiding unit, wherein the first air guiding unit can be rotated relative to the second air guiding unit about the longitudinal center axis of the device. By rotating the first air guiding unit relative to the second air guiding unit, the opening cross section of the air passages can be changed. The first and the second air guiding unit are in this instance constructed in such a manner that the air guiding member formed thereby has a closed and curved surface at least at the inflow side.

This device consequently uses the optimum technical flow properties of a curved wing without losing the adjustability of the opening cross section. The air guiding members together form a structure which is similar to a rotor, wherein the air guiding members as a whole are preferably not rotatable about the longitudinal center axis. The individual air guiding members are arranged in the manner of wings about the longitudinal center axis.

The device according to the invention preferably enables, depending on the admission pressure and position of the air guiding members, a volume flow which is constant in the selected operating state or operating point but which varies depending on the admission pressure to be adjusted.

This unit according to the invention, which will be referred to below in this instance as a throttle, can be composed in a simple manner of a few structural units, as set out below with reference to examples. It can be adjusted manually and/or in a motorized manner. The adjustment can be carried out automatically by means of the sensor and a control unit. The motor can be arranged in a hollow space in the central region of the throttle. The at least one and preferably the only sensor is preferably arranged at the location of the narrowest free flow cross section. Preferably, the sensor is arranged in the region of or on the air guiding members.

The throttle can be arranged depending on the embodiment inside a pipe, for example, clamped or adhesively bonded. However, it can also be arranged as a pipe connector between two pipe portions. Depending on the embodiment, the same throttle is suitable for both installation types.

Depending on the type of adjustability of the volume of the air guiding members, throttles can be formed in which the location of the narrowest free flow cross section, that is to say, the narrowest or smallest opening cross section, always remains at the same location, in particular with respect to the longitudinal center axis of the throttle. In a preferred embodiment, the first air guiding unit can be rotated relative to the second air guiding unit in such a manner that the smallest opening cross section in each relative rotation position of the first air guiding unit remains at the same location relative to the longitudinal center axis of the unit. This is carried out in these embodiments, regardless of the installation situation of the throttle and/or the incoming flow situation. A consistent location has in particular the advantage that a single sensor is sufficient to detect and control the flow behavior in all installation positions of the throttle.

Preferably, all the first air guiding units can be rotated together with each other relative to the second air guiding units thereof, and preferably all the air guiding units are formed from a first and a second air guiding unit. It is advantageous for the flow behavior, but also for the adjustability and the production of the throttle, when all the air guiding members have the same shape and the same dimensions.

The air guiding members are preferably arranged in a rotationally symmetrical manner about the longitudinal center axis of the device. Preferably, three or more air guiding members are present. Eight to fourteen, in particular ten or twelve air guiding members are preferred. Preferably, with regard to the mountability, the number of air guiding members is an even number.

In preferred embodiments, the air guiding members are arranged radially about an ellipsoid-like central projection. Preferably, such a projection is provided not only at the inflow side, but also at the outflow side. The throttle can thereby be used in a bidirectional manner without the flow behavior changing. This is particularly the case when the air guiding members are constructed in a mirror-symmetrical manner. Preferably, the entire throttle is constructed in a mirror-symmetrical manner. The mirror axis is located in this instance preferably centrally within the throttle and perpendicularly to the longitudinal center axis of the throttle. The two projections together form a protrusion member, also referred to as a hub member.

In a preferred embodiment, the first air guiding unit has a cross section of a portion of an ellipse and it forms an opening in the ellipse. The second air guiding unit has a U-shaped cross section with two legs and a web which connects the two legs. The two legs engage with the free ends thereof in the opening of the first air guiding unit, wherein a size of the engagement of the two legs in the opening can be changed by means of relative rotation of the two air guiding units. These shapes produce an optimum flow behavior and nonetheless enable the change of the volume of the air guiding member and consequently the spacings between adjacent air guiding members.

The flow behavior is further optimized when the web is constructed to be curved outward, wherein the outermost line thereof is preferably located centrally between the two legs. The web is preferably bent in such a manner that it forms a portion of an ellipse.

Preferably, the outermost line of the web of one of the air guiding members and an outermost line of a first air guiding unit of an adjacent air guiding member extend on a common annular face which extends perpendicularly to the longitudinal center axis of the unit, wherein this annular face when the first air guiding unit is rotated relative to the respective second air guiding unit of the two adjacent air guiding members retains its position relative to the longitudinal center axis. This enables a consistent position of the narrowest free flow cross section regardless of the rotation position of the first and second air guiding units with respect to each other.

In preferred embodiments, the second air guiding unit comprises a first and a second blade, wherein all the first blades are arranged in a common portion and all the second blades are arranged in a common second portion. The two portions are constructed to be able to be assembled, wherein the two portions in the assembled state receive between them the first air guiding units which can be rotated relative thereto.

Preferably, each of the first air guiding units comprises a first air guiding element and a second air guiding element, wherein all the first air guiding elements are arranged in a common portion and all the second air guiding elements are arranged in a common second portion. The two portions are constructed to be able to be assembled in order to form a common rotatable portion.

These preferred embodiments of the air guiding units enable the production of integral structural units which can be assembled in a simple manner. In particular, the structural units can be produced from plastics material in an injection-molding method. The production costs are consequently minimized and the assembly of the throttle is simplified. It is thereby particularly possible to produce throttles which in the assembled state are constructed in a mirror-symmetrical manner and which can thereby be used in a bidirectional manner.

In another embodiment which is suitable for unidirectional use, the first air guiding unit has a hook-like cross section with a short leg, a long leg and a rounded curved portion. The second air guiding unit has an L-shaped cross section with a short leg, a long leg and a rounded angular curved portion which connects the two legs and which is less than 90°. The short leg of the first air guiding unit is located on the short leg of the second air guiding unit and it can be displaced when rotated relative thereto. The spacing from an adjacent air guiding member is thereby changed.

This embodiment can also be produced from individual structural units, in particular from plastics material. The individual structural units can be assembled in a simple manner.

Other embodiments are set out in the dependent claims.

BRIEF DESCRIPTION OF THE DRAWINGS

Preferred embodiments of the invention are described below with reference to the drawings, which have only an explanatory purpose and are not intended to be interpreted to be limiting. In the drawings.

DESCRIPTION OF PREFERRED EMBODIMENTS

Figure 1:
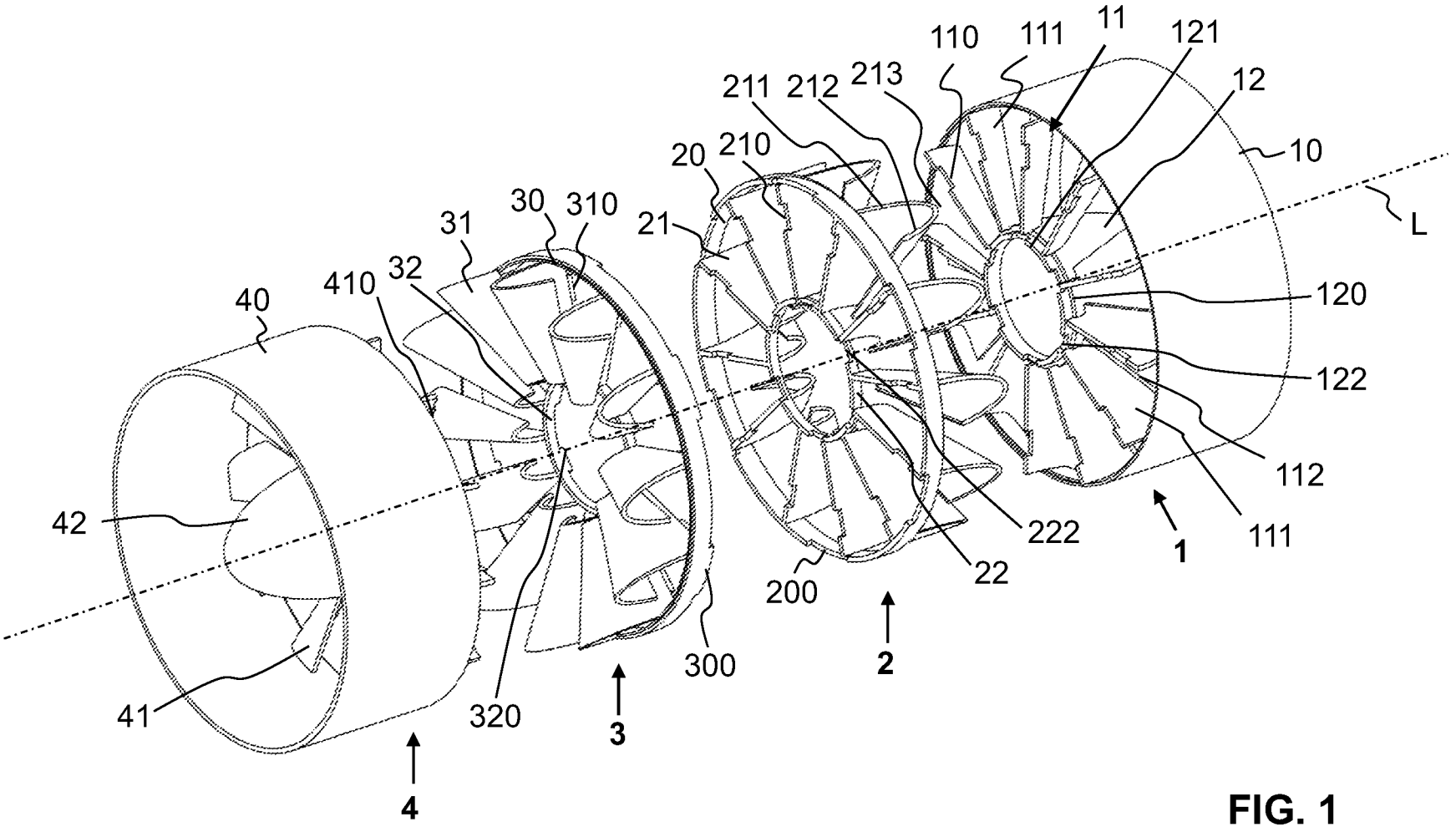
FIG. 1 shows a perspective view of a device according to the invention for adjusting an air volume flow in an exploded view according to a first embodiment.

FIG. 1 shows a preferred device according to the invention, referred to below as a throttle, in four individual components. Each of the four components 1, 2, 3, 4 is preferably constructed in an integral manner and forms an independent structural unit. The four components 1, 2, 3, 4 are preferably produced from plastics material.

A first portion 1 has a hollow-cylindrical first housing 10. Radially inwardly protruding first blades 11 are arranged on the inner circumference of the first housing 10. The blades 11 are preferably distributed with uniform spacing over the entire inner circumference of the housing 10. Each blade 10 has a first wall 111 and a second wall 112 which is formed thereon. The first wall 111 extends parallel or, as in this example, in a slightly inclined manner with respect to a longitudinal center axis L of the throttle. The second wall 112 extends at an angle of 90° or more relative to the first wall 111 and consequently approximately or slightly inclined relative to a plane which extends perpendicularly to the longitudinal center axis L. Preferably, the second wall 112 is constructed in a curved manner.

The first wall 111 of the individual blades 11 preferably projects from the first housing 10 at the end face. The second wall 112 of the individual blades 11 is preferably located inside the first housing 10. Preferably, all the first blades 11 are constructed identically, that is to say, with the same shape and same size. They preferably protrude to the same extent from the first housing 10 and they are preferably arranged on a circle which extends concentrically with respect to the longitudinal center axis L.

The first wall 111 of each blade 11 has a recess 110 on the end face opposite the second wall 112. This recess is constructed in a rectangular manner in this example. The width of the first wall 111 is preferably constructed to taper inward. The wall thickness preferably remains constant.

The individual blades 11 are formed on or secured to the inner wall of the first housing 10 with a front wider end and they retain with the inner front narrower ends thereof an inner ring, referred to in this instance as the hub 120. The hub 120 is preferably also constructed integrally with the blades 11 and the first housing 10. The hub 120 preferably does not project from the first housing 10. It has flaps 121 which protrude axially with respect to the adjacent front end of the first housing 10 and which are interrupted by recesses 122. The recesses 122 and the flaps 121 are preferably arranged in a state distributed in a uniform manner over the circumference of the hub 120.

At the opposing end, the hub 120 merges via a radially outwardly protruding circumferential step 123 into a projection 12. Preferably, the blades 11 are also secured to the outer circumference of the projection 12 and even more preferably formed integrally thereon. The projection 12 preferably has the aerodynamic shape of an ellipsoid. It is arranged within the first housing 10 and preferably does not project above it.

The fourth portion 4 of the device is preferably identical to the first portion 1 or is constructed in a mirror-symmetrical manner with respect to the first portion 1. It is therefore not described in detail here. The above description is intended to be used in a similar manner. This fourth portion 4 also has a hollow-cylindrical base member 4, referred to in this instance as the second base member 40. The blades are referred to as second blades 41, wherein they in each case in place of the recesses have flaps 410 and a first wall 411 and a second wall 412. In this instance, a projection 42, a hub 420, flaps 421, recesses 422 and a step 423 are also provided again.

The fourth portion 4 is arranged in a mirrored manner with respect to the first portion 1 so that the projections 12, 42 thereof are directed away from each other, that is to say, the narrow ends of the projections are directed outward, that is to say, facing away from the throttle.

The flaps 421 and recesses 422 of the fourth portion 4 are arranged in such a manner that they engage in the recesses 124 and flaps 121 of the first portion 1 so that a positive-locking connection between the first and fourth portion can be produced. When the connection is produced, the two steps 123, 423 of the first and fourth portion 1, 4 are spaced apart from each other, wherein inner rings 22, 32 of the second and third portion 2, 3 which are mentioned below are arranged therebetween.

The two additional portions 2, 3 are arranged between the first and the fourth portion 1, 4. These portions 2, 3 may also be together in the form of a single structural unit, that is to say, a common central portion. Preferably, however, they comprise two separate structural units, wherein each structural unit is preferably constructed in an integral manner. This facilitates the production and the assembly.

The second portion 2 has a first outer ring 20 on which first air guiding elements 21 are formed or secured. The first air guiding elements 21 are preferably arranged in a manner distributed with uniform spacing over the inner circumference of the first outer ring 20. They protrude radially inward and terminate on a common first inner ring 22. The number of first air guiding elements 21 corresponds to the number of first and second blades 11, 41 of the first and fourth portion 1, 4. The inner diameter of the first inner ring 22 is identical to or preferably greater than the outer diameter of the hub 120 of the first portion 1 so that the first inner ring 22 can surround the hub 120.

The first inner ring 22 has at the side thereof facing away from the first portion 1 recesses 222 which are preferably arranged in a state distributed in a uniform manner over the circumference. The end face, facing the first portion 1, of the first inner ring 22 is preferably constructed in a planar and stepless manner.

The first outer ring 20 also has at the side thereof facing away from the first portion 1 recesses 200 which are preferably arranged in a state distributed in a uniform manner over the circumference. The end face, which faces the first portion 1, of the first outer ring 20 is preferably also constructed in a planar and stepless manner. The outer diameter of the first outer ring 20 preferably corresponds to the outer diameter of the housing of the first portion 1 so that the outer surfaces of these two portions 1, 2 are in alignment with each other in the assembled state.

The first air guiding elements 21 are constructed in a curved manner. They preferably have a u-shaped or I-shaped cross section. A first leg 211 is secured to the first outer ring and to the first inner ring 20, 22. It has recesses 210 which face away from the first portion 1. A short second leg 212 terminates freely. The angle between the two legs 211, 212 is preferably greater than 90°. The two legs 211, 211 are preferably constructed to be curved in cross section. The free end face of the shorter second leg 212 is preferably constructed in a planar and stepless manner.

Each first air guiding element 21 preferably has in cross section the form of a portion of an ellipse, wherein this portion contains a curve of the ellipse. Preferably, all the cross sections through the first air guiding element 21 have such a shape.

The first air guiding elements 21 taper toward the first inner ring 22. That is to say, in cross section, the cross section of the ellipse becomes smaller. The width of at least one of the legs 211, 212, preferably of both legs 211, 212, becomes smaller toward the first inner ring 22. Preferably, the opening angle of the ellipse also becomes smaller in the direction toward the inner ring 22.

The first air guiding elements 21 are directed toward the first portion 1, wherein the closed curved portion 213 thereof is arranged toward the first portion 1. The shorter leg 212 of the first air guiding elements 21 terminates with spacing from the first outer ring and first inner ring 20, 22.

The third portion 3 is preferably constructed in terms of shape and size to be identical to the second portion 2, wherein only the connection elements are formed to precisely mirror the second portion 2. Reference may consequently be made to the above description. The third portion 3 also has an outer ring and an inner ring which are referred to as the second outer ring 30 and second inner ring 32. The air guiding elements are referred to as second air guiding elements 31. They have a longer leg 311, a shorter leg 312 and a curved portion 313. The number of air guiding elements 31 corresponds to the number of first air guiding elements 21. The arrangement thereof over the circumference of the third portion 3 is also identical to the second portion 2. They protrude with the closed curved portion 313 thereof away from the second portion 2 and toward the fourth portion 4.

However, on the second outer ring 30, facing the second portion 2, in place of the recesses, there are provided flaps 300 which engage in the recesses 200 of the first outer ring 20. On the second inner ring 32, in place of the recesses, there are also arranged flaps 320 which face the second portion 2 and which engage in the recesses 222 of the first inner ring 22. 15 The second air guiding elements 31 have on the first longer leg flaps 310 which engage in the recesses 210 of the first air guiding elements 21.

Figure 2:
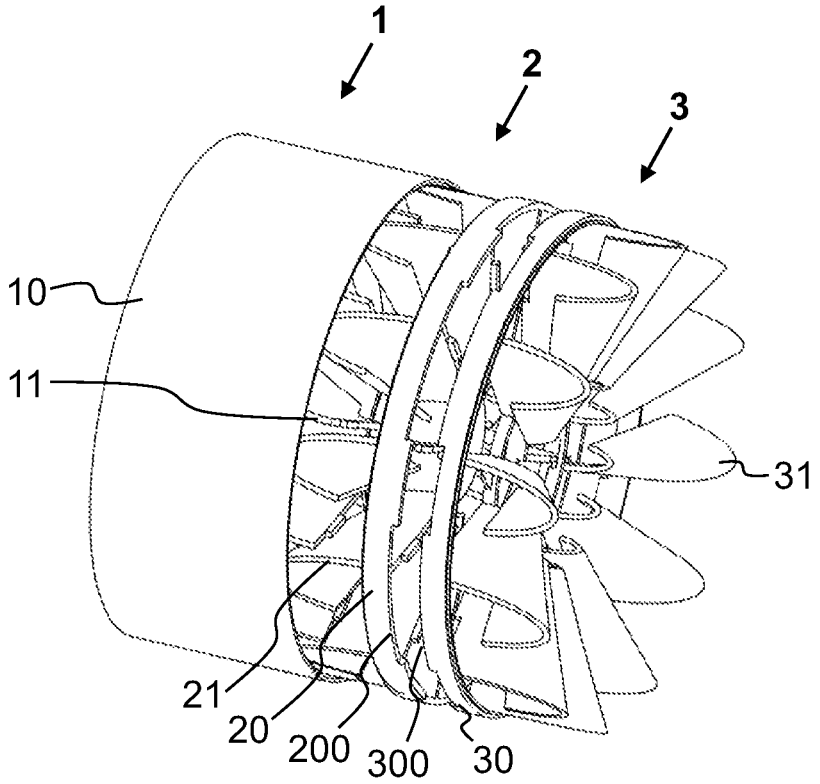
FIG. 2 shows a perspective view of the device according to FIG. 1 during the assembly in a first step.
Figure 3:
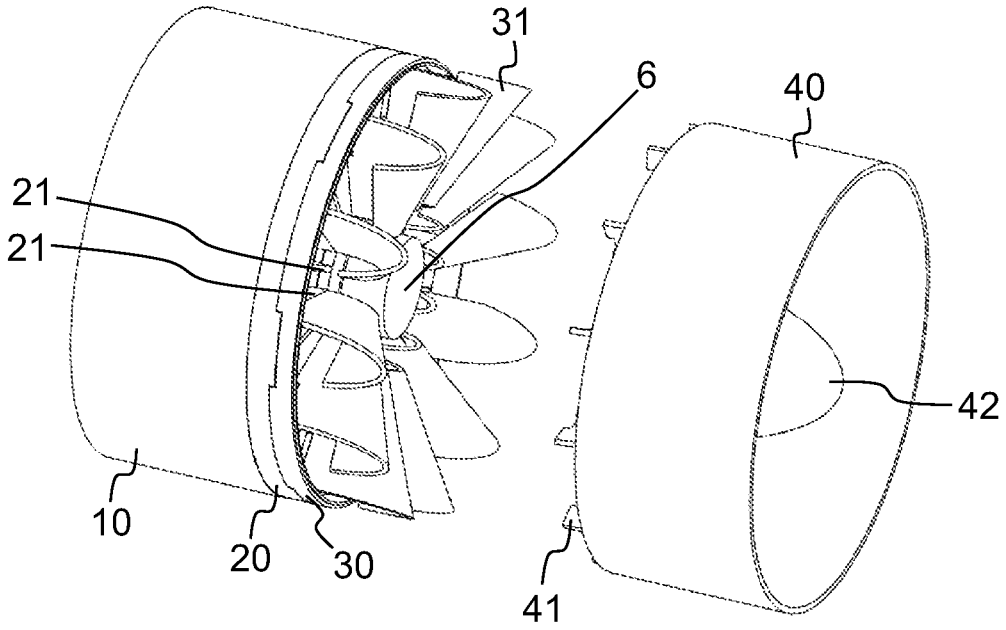
FIG. 3 shows a perspective view of the device according to FIG. 1 during assembly in a second step.

FIGS. 2 and 3 now show how the individual components of the throttle according to the invention can be assembled.

The second and third portion 2, 3 are assembled and preferably snap-fitted. This is illustrated in FIG. 2. In this instance, the respective flaps of the second rings 30, 32 and the second air guiding elements 31 are located engage in the recesses of the first rings 20, 22 and first air guiding elements 21. The end faces of the longer legs 211, 311 of the first and second air guiding elements 21, 31 are in this instance located in alignment on each other. This can be seen in FIG. 3. The shorter legs 212, 312 of the respective two air guiding elements 21, 31 terminate with spacing from each other. The two air guiding elements 21, 31 together form a first air guiding unit which forms a partial elliptical member with a lateral opening. The reference numeral 6 in FIG. 3 indicates a schematically illustrated motor 6 which is described further below in the text.

The second and the third portion 2, 3 can be inserted individually or in an assembled state into the first portion 1. Subsequently, the fourth portion 4 can be connected to the first portion 1 by the hubs 120, 420 thereof being connected to each other by means of the flaps 35 121, 421 and recesses 122, 422. At the same time, the flaps 410 of the second blades 41 of the fourth portion 4 engage in the recesses 110 of the first blade 11 of the first portion 1.

A first and second blade 11, 41 form in each case a U-shaped element with two legs which extend parallel with each other and a web which connects these legs. Preferably, the web is constructed to be curved outward. More preferably, this curved portion of the web is a portion of an ellipse. This U-shaped element forms a second air guiding unit.

The inner rings 22, 32 of the second and third portion 2, 3 engage around the hubs 120, 420 of the first and fourth portion 1, 4. This situation is illustrated in FIG. 3.

Figure 4:
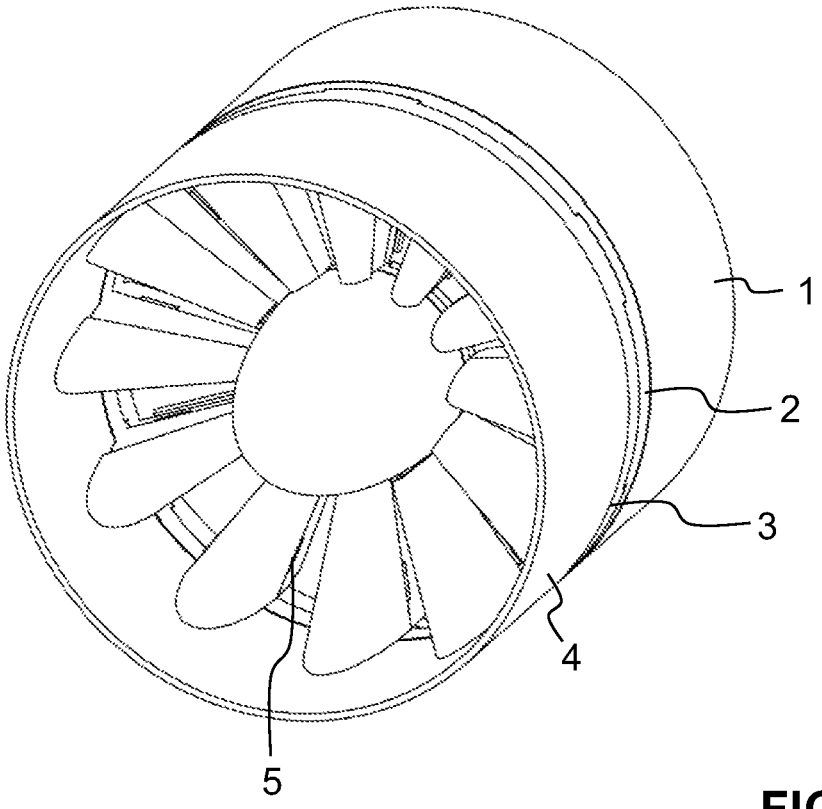
FIG. 4 shows a perspective view of the device according to FIG. 1 in the assembled state in a first position for use.
Figure 5:
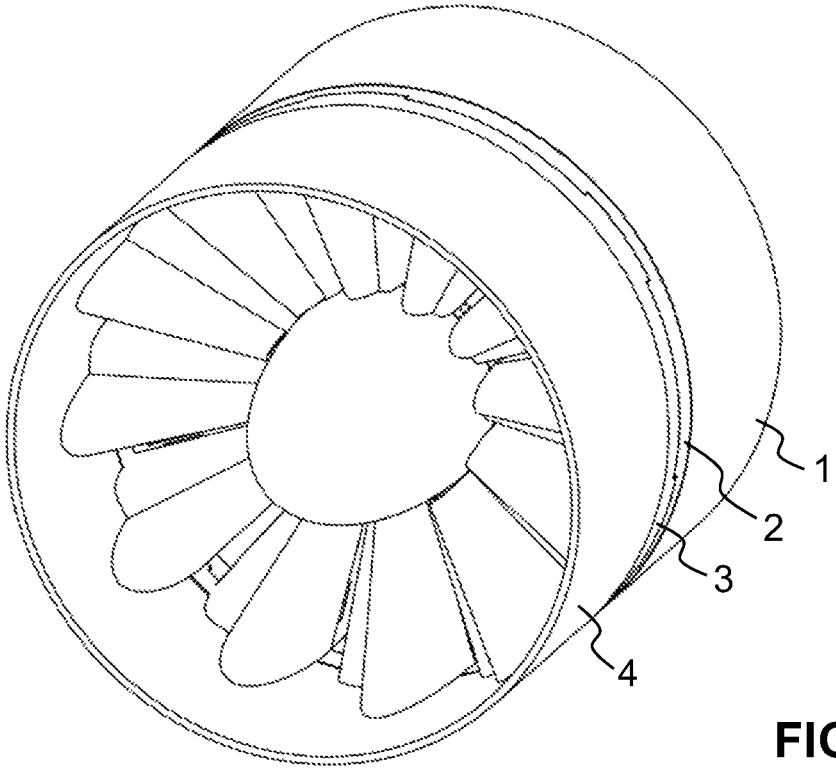
FIG. 5 shows a perspective view of the device according to FIG. 1 in the assembled state in a second position for use.

FIGS. 4 and 5 illustrate the throttle according to the invention in the assembled state. It can be clearly seen that the outer surface of the throttle is in the form of a consistent face and preferably has no projections or recesses. The individual surfaces of the individual portions 1, 2, 3, 4 are in alignment with each other.

Figure 8:
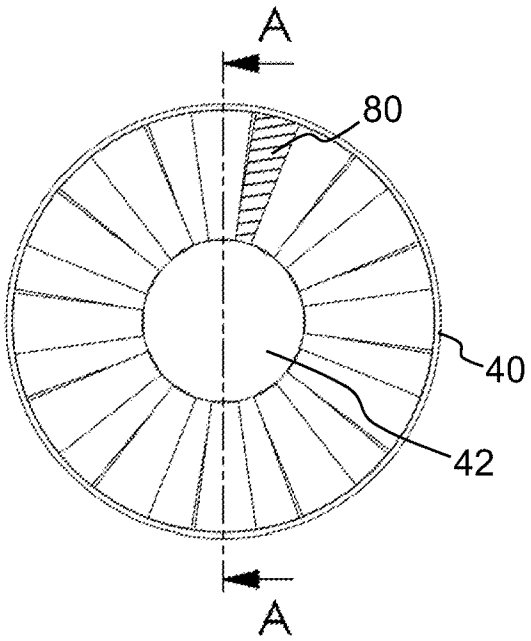
FIG. 8 shows a view of the device according to FIG. 1 from the front.

FIG. 8 shows a view of the throttle. The free flow cross sections are located between the individual radially outwardly extending air guiding members. One of the free flow cross sections is illustrated with shading in the Figure and given the reference numeral 80.

In the assembled state, the free end face of the shorter leg of the first and second air guiding elements 21, 31 is located on the second wall 112, 412 of the respective first and second blade 11, 41. This can be clearly seen in FIGS. 6*a* and 7*a*.

The first and second blades 11, 41 form together with the associated first and second air guiding elements 21, 31 a closed member which can be changed in terms of its shape depending on the rotation position of the second and third portion 2, 3 relative to the first and fourth portion 4. In a first position according to FIG. 6*a*, the blades 11, 41 and air guiding elements 31, 31 each form a common member whose cross sections each have the form of an ellipse or an approximately ellipse-like form. In the second position according to FIG. 7*a*, they form a member having a shape which in the cross sections thereof corresponds to an ellipse having a laterally appended narrower rectangle with rounded walls. In place of the ellipse, an ellipse-like form is also possible here, that is to say, a shape which is approximately an ellipse.

This closed member forms an air guiding member 9 inside the throttle. The air guiding members 9 and the arrangement thereof on the projection member, which is formed by the two projections 12, 42, can be clearly seen in FIG. 10. The projection member is also called a hub member. The individual air guiding members 9 are arranged in a state distributed over the circumference of the throttle with spacing from each other. The spacing forms the air passage openings of the throttle, as can be clearly seen in FIG. 10.

Figure 6A:
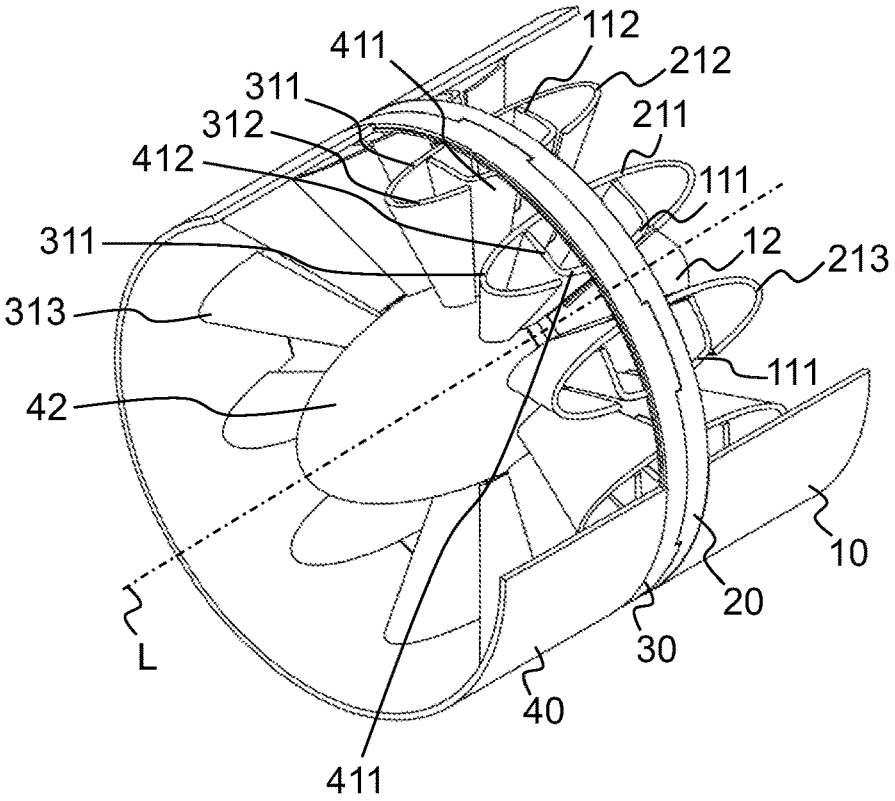
FIG. 6*a* shows a perspective view of a portion of the device according to FIG. 1 in the assembled state in a first position for use.
Figure 7A:
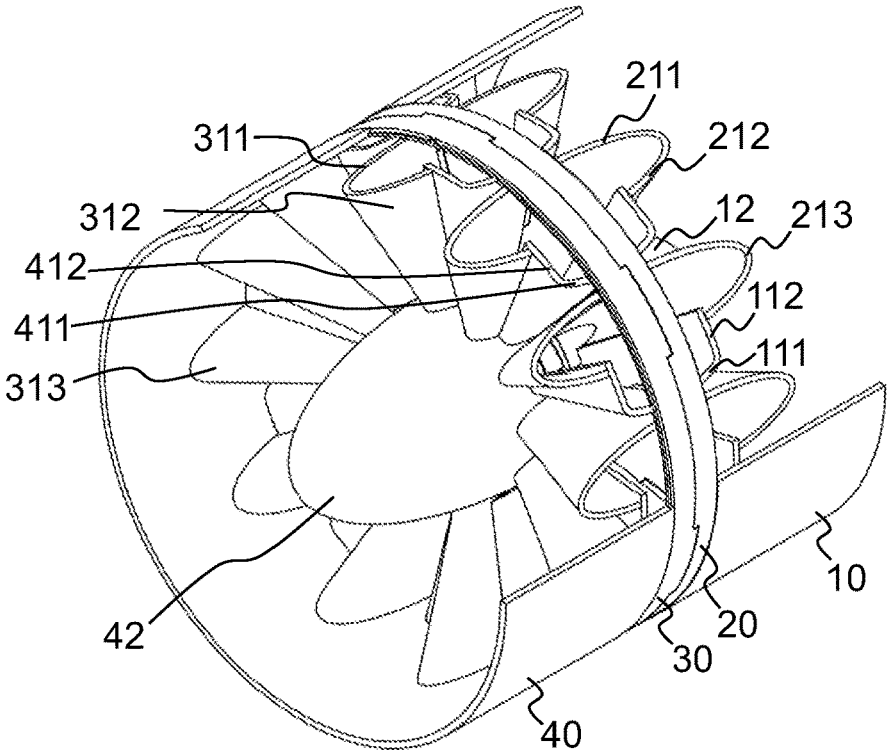
FIG. 7*a* shows a perspective view of the portion of the device according to FIG. 6*a* in a second position for use.
Figure 10:
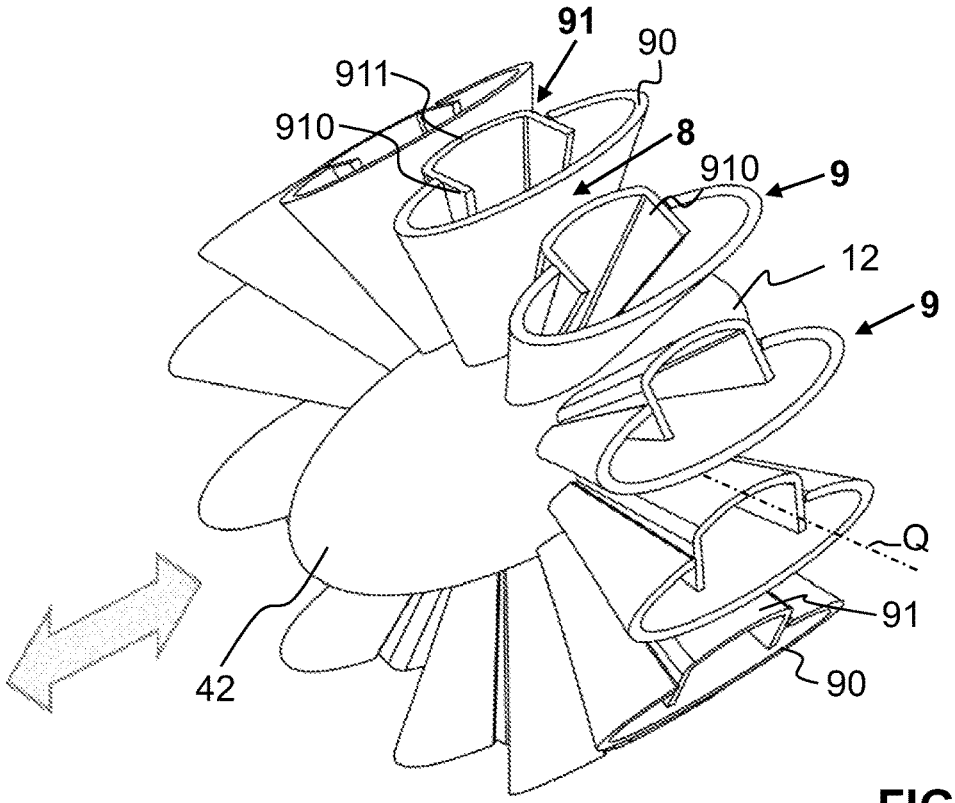
FIG. 10 shows a perspective illustration of internal elements of the unit according to the invention according to FIG. 1.

As can also be clearly seen in FIGS. 6*a*, 7*a* and 10, the air guiding members 9 are arranged with respect to the longitudinal center axis L at the same height and preferably constructed to be identical.

In FIG. 10, no separation lines which would show the elements of the individual portions 1, 2, 3 are illustrated. These separation lines can be derived from the remaining Figures and the description. In addition, these separation lines are depending on the embodiment not present as in this example, but instead they may be located at another location. As already illustrated, the two inner portions 2, 3 may be constructed together integrally. In other embodiments, other portions or elements may also be constructed together in an integral manner. The above-described connection means in the form of recesses and flaps can also be replaced by other suitable connection means, preferably by means of snap-fitting or locking elements.

The air guiding elements 21, 31 form the first air guiding unit in the form of a partial elliptical member 90 the cross section of which represents a non-closed ellipse. The closer the cross section is located to the longitudinal center axis L, the smaller the ellipse is and the smaller the angles of the two ellipse curves are.

The two blades 11, 41 form the second air guiding unit in the form of the U-shaped element 91, against the two legs 910 of which the free ends of the elliptical member 90 abut or terminate with slight spacing therefrom in order to enable an unimpeded adjustment. The web 911 of the U-shaped element 91 is bent outward in the form of an ellipse portion. The web 910 has a longitudinal center axis Q which extends perpendicularly to the longitudinal center axis L of the throttle. The line of the web 910 along this longitudinal center axis Q protrudes the furthest forward. When viewed in the direction of the longitudinal center axis L of the throttle, at the opposing side of the air guiding member 9 the corresponding line of the wall of the partial ellipse member 90 protrudes furthest forward at the same location. These lines consequently define the region or the location of the narrowest flow cross section 8. The flow cross section becomes smaller, the closer the corresponding location is to the longitudinal center axis L of the throttle.

As already mentioned, the shape of the air guiding members 9 can be changed by rotating the two inner portions, that is to say, the second and third portion 2, 3 together. The spacings between the air guiding members 9 are thereby also changed. Preferably, all the spacings are changed to the same degree. The free throughflow opening of the throttle can consequently be changed. The reason for this is that by rotating the two portions 2, 3 the shorter leg 212, 312 of the first and second air guiding element 21, 31 is pushed over the shorter leg 112, 412 of the first and second blades 11, 41 and, consequently, the shape of the closed air guiding member 9 is moved from the situation with a maximized passage opening according to FIG. 6*a* into the situation with a minimized passage opening according to FIG. 7*a*.

Preferably, the air guiding members 9 have in any position no rectangular and/or sharp-edged surfaces. The surface of the individual air guiding members 9 is in any rotation position of the throttle constructed in a rounded manner. This reduces the technical flow resistance in an optimum manner.

Regardless of the rotation position of the two inner portions 2, 3, the region of the narrowest flow cross section always remains at the same location, regardless of the installation situation and the incoming flow relationships. This location is located in this example between the bent U-shaped element 91, which is formed by the first and second blade 11, 20 41, of a first guiding member 9 and the bent rear 211, 311 of the partial elliptical member 90, which is formed by the first and second air guiding element 21, 31 of an adjacent air guiding member 9. It is given the reference numeral 8 in FIG. 10.

The region of the narrowest flow cross section 8 is located at the location at which the curved web 911 of the U-shaped element 91 protrudes the most. This location is in this example, in which the individual portions 1, 2, 3, 4 are constructed symmetrically and substantially identically, at the connection location of the first and second blade 11, 41 of the first and fourth portion 1, 4. This also corresponds in this portion to the connection location of the two air guiding elements 21, 31 of the second and third portion 2, 3.

The U-shaped element 91 formed by the two blades 11, 41 optimizes the technical flow properties. Since the web 911 is curved, occurrences of flow separation are prevented, pressure losses are prevented and the noise generation is reduced. The linear construction of the legs 910 of the U-shaped element 91 enables an optimum connection to the air guiding elements 21, 31 in any rotation position of the central portions 2, 3. Since the air guiding members 9 have no sharp edges, an undesirable noise generation is prevented.

Depending on the embodiment, the projections 12, 42 of the first and fourth portion 1, 4 project in the inflow direction or outflow direction from the air guiding members 9, as can also be seen in FIGS. 6*a* and 7*a*, or they are arranged behind the foremost surface of the air guiding members in each case.

Figure 9:
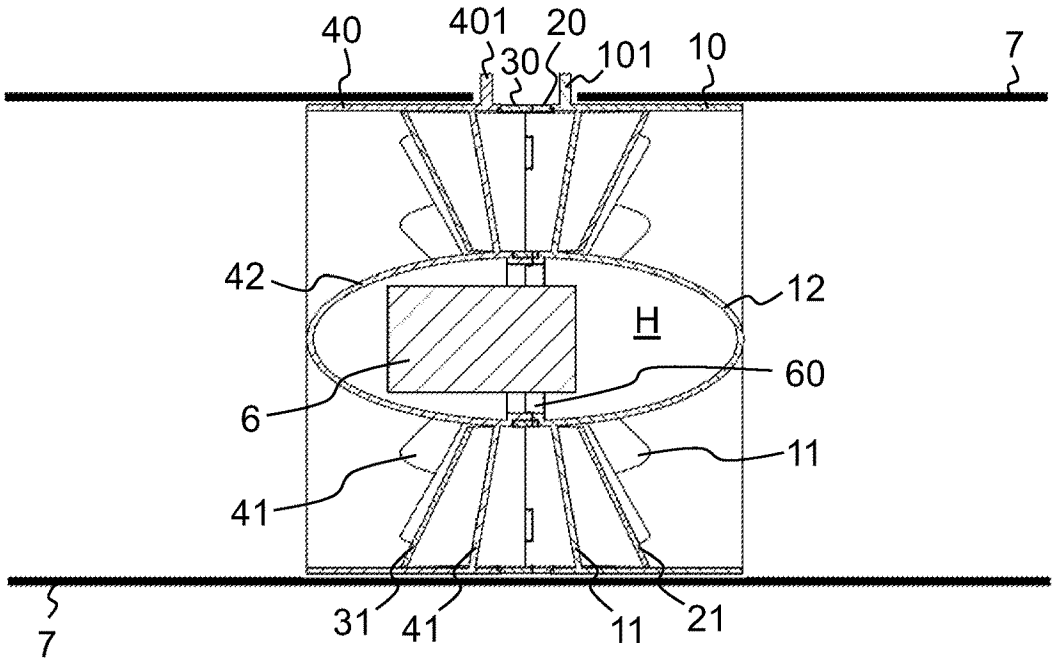
FIG. 9 shows a longitudinal section through a variant of the device according to FIG. 1, in a state installed in a ventilation pipe.

In FIG. 9, in the same Figure two installation situations are illustrated in a ventilation pipe 7, preferably in a pipe 7 with a round cross section. The throttle according to the invention can be introduced completely inside the pipe 7 and secured at that location. This is illustrated in the lower region of FIG. 9. However, the throttle can also alternatively be used as a pipe connection piece. This is illustrated in the upper region of FIG. 9.

For use as a pipe connection piece, at least one radially outwardly protruding stop web 101, 401 is preferably provided on the first and on the fourth portion 1, 4. Preferably, a plurality of stop webs 101, 410 are provided in a state distributed over the circumference. The two pipe portions 7 can be joined to these webs 101, 401. In this installation situation, the throttle can be activated manually and/or in a motorized manner depending on the embodiment. In the event of manual activation, the first and second handles 201, 301 are freely accessible. However, they are not illustrated in FIG. 9.

For use inside the pipe 7, the throttle depending on the embodiment is constructed without any stop webs 101, 401 and handles 201, 301. It is preferably activated in a motorized manner. Alternatively, the stop webs 101, 401 and/or the handles 201, 301 are present. However, they can be broken away prior to assembly in a pipe 7. Preferably, they are provided with desired breaking locations for this purpose.

As a result of the mirror-symmetrical configuration of the throttle, it can be used in a bidirectional manner. That is to say, it can be mounted in both flow directions and it has in both flow directions the same functional properties. This bidirectional ability to be subjected to inflow is indicated by the double-headed arrow in FIG. 10.

Figure 6B:
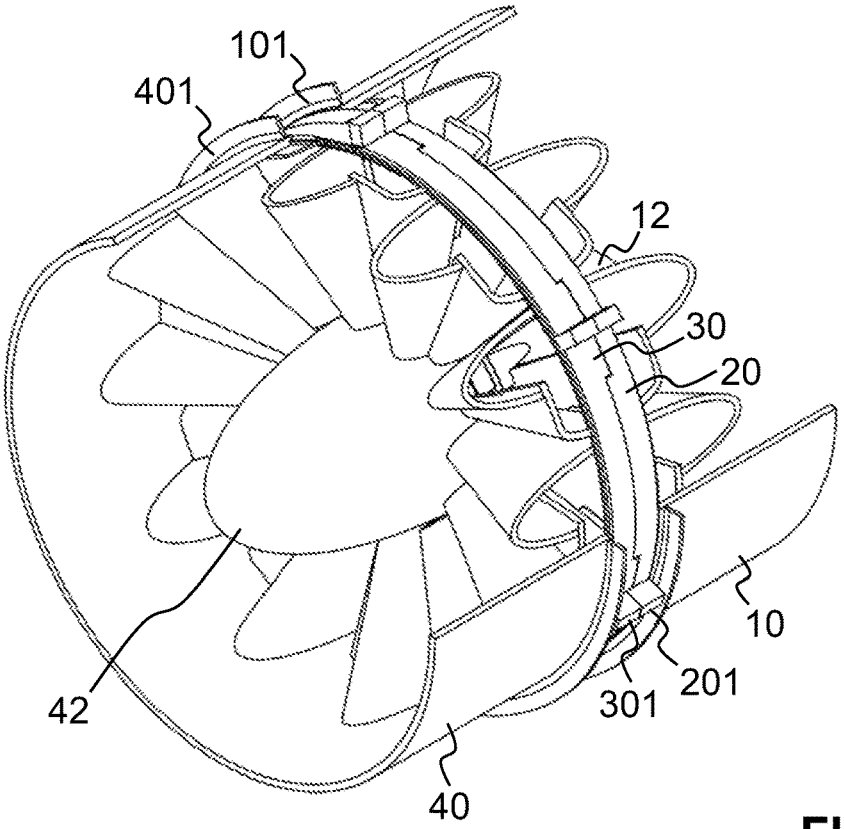
FIG. 6*b* shows a perspective view of a variant of a portion of the device according to FIG. 1 in the assembled state in a first position for use.
Figure 7B:
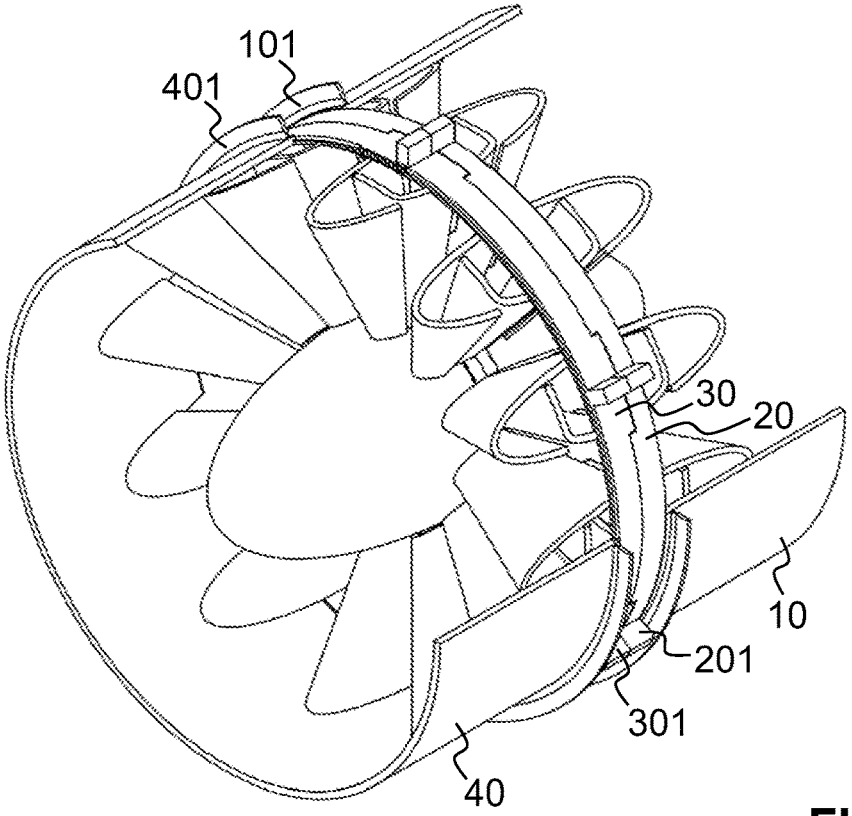
FIG. 7*b* shows a perspective view of the portion of the device according to FIG. 6*b* in a second position for use.

The two outer portions 1, 4 are arranged in a rotationally secure manner in the ventilation pipe 7. The two inner portions 2, 3 can be rotated together relative to the two outer portions 1, 4 and consequently also with respect to the ventilation pipe 7. Depending on the embodiment and installation situation, they can be rotated manually. To this end, at least one handle is preferably provided on at least one of these two portions. As illustrated in FIGS. 6*b* and 7*b*, the second and third portion 2, 3 have at the circumference thereof at least a first and a second radially outwardly protruding handle 201, 301 which in the assembled state of the two portions 2,3 are in alignment with each other and form a common handle. In this example, a plurality of such handles 201, 301 are arranged in a state distributed over the circumference.

Alternatively or additionally, the two inner portions 2, 3 can also be rotated together by means of the motor 6. FIG. 9 shows that a corresponding motor can be arranged in the hollow space H which by the two attached projections 12, 42 in order to thus rotate the two inner portions 2, 3. A corresponding gear mechanism 60 is preferably arranged inside the hollow space H, for example, a gear drive having an inner gear.

A wireless or wired connection to an external control unit, in particular to a control unit of a ventilation system of the air distribution network, for example, a building control system, is possible. The power supply of the motor can be carried out via a corresponding power line or it can also be arranged in the hollow member of the projections 12, 42. In one embodiment, there is provided in the throttle a generator which is supplied with power by means of rotational movements and/or flow movements of a turbine-like apparatus which is driven outside the projection by the air flow.

In preferred embodiments, a sensor 5 is further provided. This can be arranged, for example, as can be seen in FIG. 4, on an outer side of one of the air guiding members 9. However, other positions, for example, on one of the two inner rings, are also possible. Preferably, it is arranged along the line which defines the region of the narrowest flow channel 8.

A plurality of sensors can be used. Preferably, only one sensor is provided. By means of the at least one sensor 5, flow speeds, temperatures and/or $CO_2$ or VOC concentrations (VOC=Volatile Organic Compounds) are measured. A Peltier element or a hot-wire anemometer is particularly suitable as a sensor 5 for measuring flow speeds or temperatures.

The at least one sensor 5 is preferably connected to a control unit of the motor 6 and/or the ventilation system of the air distribution network. The throttle can thereby be automatically activated in accordance with the sensor measurement values.

Figure 11:
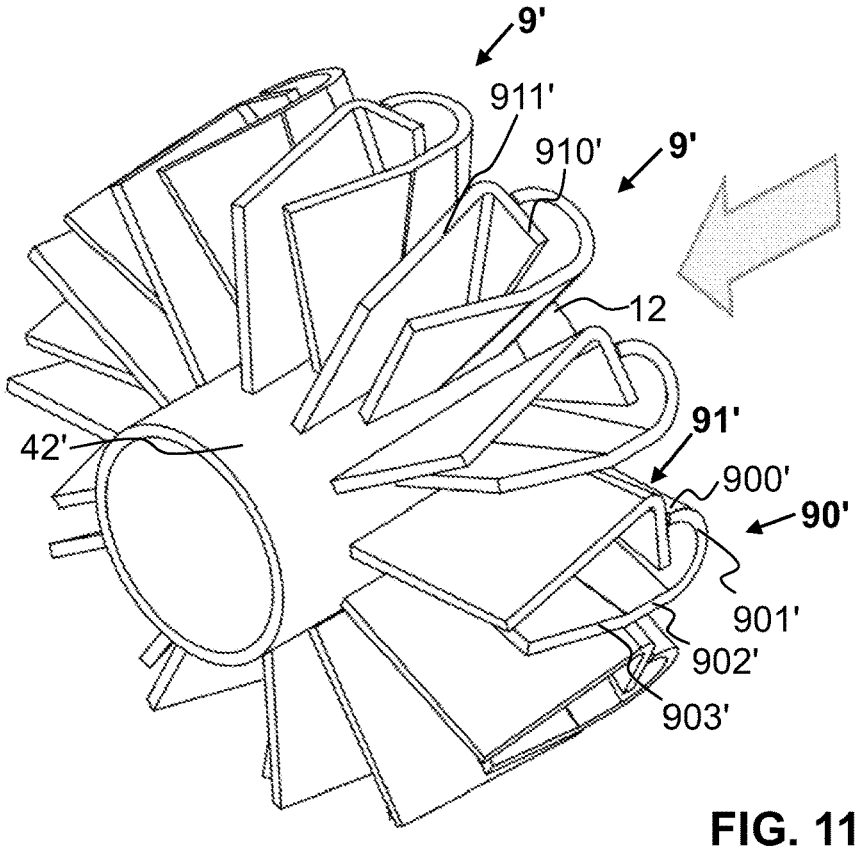
FIG. 11 shows a perspective illustration of internal elements of the unit according to the invention in another embodiment.

In FIG. 11, an inner portion of another embodiment is illustrated. The basic structure with four portions which are pushed one inside the other, is preferably the same. However, fewer portions may also be present. Outer rings and outer housings are also provided in this instance but are not illustrated. This throttle can be subjected to flow at only one side, as indicated with the wide arrow. At this inflow side, the projection 12 which is preferably constructed as an ellipsoid is again formed. At the opposing side, the outflow side, in place of a projection, a sharp-edged break-away or the wide end of a drop is provided. In this example, this rear portion 42' is configured as a sharp-edged break-away in the form of a hollow cylinder.

The air guiding members 9' have a different form from those according to FIGS. 1 to 10. They each comprise a hook-like element 90' and an L-shaped element 91'. The hook-like element 90' has a short leg 900' which extends at the free end parallel with the longitudinal center axis L of the throttle and which is used for support on the L-shaped element 91'. The short leg 900' merges via a curved portion 901' into a longer leg which comprises two part-legs. The first part-leg 902' adjoining the curved portion 901' extends at an angle with respect to the longitudinal center axis L of the throttle. Preferably, it is constructed in a linear manner. The second part-leg 903' which follows the first part-leg 902' extends at a larger angle with respect to the longitudinal center axis L of the throttle. It is preferably constructed in a linear manner. The second part-leg 903' may, however, also be constructed in a curved manner.

The L-shaped element 91' has a short leg 910' and a long leg 911'. The two legs 910', 911' form an angle of preferably less than 90°. The short leg 910' extends preferably in a plane perpendicular with respect to the longitudinal center axis L of the throttle. The outer surface thereof serves to displaceably support the short leg 900' of the hook-like element 90'. The long leg 911' of the L-shaped element 91' is inclined toward the second part-leg 903'. It preferably extends further toward the outflow end of the throttle than the second part-leg 903'. The outer side of the angle of the L-shaped element 91' is preferably constructed in a rounded manner so that the air guiding member 9' has no sharp edges at the inflow side. The air guiding member 9' is closed at the inflow side. At the outflow side, it may be constructed to be open.

The spacings between two adjacent air guiding members 9' or 90' and 91' again define the flow cross section of the throttle. The spacing between the outer surface of the first part-leg 902' and the outer surface in the region of the angle of the L-shaped element 91' defines in this example the region of the narrowest flow cross section 8. This region is in turn linear and extends from the outer end of the air guiding member 9' up to the inner ring or the projection 12. This region corresponds as in the first example to an annular face which is interrupted by the air guiding members 9' and which extends perpendicularly to the longitudinal center axis L of the throttle.

The hook-like element 90' may be constructed in one or more pieces. It is secured to one or more portions of the throttle or formed thereon.

The L-shaped element 91' is also constructed in one or more pieces. It is secured or formed on one or more other portions of the throttle.

Either the portions on which the hook-like element 90' is arranged with respect to the portions on which the L-shaped element 91' is arranged can be rotated or pivoted about the longitudinal center axis L of the throttle or vice versa. If the elements 90', 91' are secured to a plurality of portions, they can be rotated or pivoted together as a group. All portions or portion groups may also be able to be rotated or pivoted.

As a result of the relative rotation or pivoting of the elements 90', 91', the short leg 900' of the hook-like element 90' moves relative to the short leg 910' of the L-shaped element 91'.

The shape of the air guiding member 9' and the spacing between adjacent air guiding members 9' change. As in the previous example, however, the location of the smallest flow cross section 8 remains the same.

The throttle according to the invention enables the adjustment of a constant air volume flow and a change of the free flow cross section, wherein the location of the narrowest flow cross section is consistent in different installation positions.

The invention claimed is:

1. A device for adjusting an air volume flow, in particular in an air distribution network, wherein the device has air guiding members which extend in a radial direction and in a state distributed about a longitudinal center axis of the device, wherein between adjacent air guiding members there are formed air passages, and wherein the air passages can be adjusted in terms of their opening cross section, wherein at least some of the air guiding members are formed from a first and a second air guiding unit, wherein the first air guiding unit can be rotated relative to the second air guiding unit about the longitudinal center axis of the device, wherein, by rotating the first air guiding unit relative to the second air guiding unit, the opening cross section of the air passages can be changed and wherein the air guiding member formed by the first and the second air guiding unit has a closed and curved surface at least at the inflow side, wherein the first air guiding unit has a cross section of a portion of an ellipse and forms an opening in the ellipse, wherein the second air guiding unit has a U-shaped cross section with two legs and a web which connects the two legs, wherein the two legs have free ends and wherein the free ends engage in the opening of the first air guiding unit, and wherein a size of the engagement of the two legs in the opening can be changed by means of relative rotation of the two air guiding units.

2. The device as claimed in claim 1, wherein the first air guiding unit can be rotated relative to the second air guiding unit in such a manner that a smallest opening cross section in each relative rotation position of the first air guiding unit remains at the same location relative to the longitudinal center axis of the device.

3. The device as claimed in claim 1, wherein all the first air guiding units can be rotated together with each other relative to the second air guiding units thereof.

4. The device as claimed in claim 1, wherein all the air guiding members are formed from a first and a second air guiding unit.

5. The device as claimed in claim 1, wherein all the air guiding members have the same outer shape and same outer dimensions.

6. The device as claimed in claim 1, wherein the air guiding members are arranged in a rotationally symmetrical manner about the longitudinal center axis of the device.

7. The device as claimed in claim 1, wherein the air guiding members are arranged radially about an ellipsoid central projection.

8. The device as claimed in claim 1, wherein the web is curved outward.

9. The device as claimed in claim 8, wherein an outermost line of the web of one of the air guiding members measured in a radial direction of the curve of the web and an outermost line of a first air guiding unit of an adjacent air guiding member measured in the radial direction extend on a common annular face which extends perpendicularly to the longitudinal center axis of the device, wherein this annular face when the first air guiding unit is rotated relative to the respective second air guiding unit of the two adjacent air guiding members keeps its position consistent relative to the longitudinal center axis of the device.

10. The device as claimed in claim 1, wherein the second air guiding unit comprises a first and a second blade, wherein all the first blades are arranged in a common first portion and all the second blades are arranged in a common second portion, wherein the common first portion and the common second portion in an assembled state receive between them the first air guiding units which can be rotated relative thereto.

11. The device as claimed in claim 1, wherein each of the first air guiding units comprises a first air guiding element and a second air guiding element, wherein all the first air guiding elements are arranged in a common portion and all the second air guiding elements are arranged in a common second portion, wherein the two portions are assembled and form a common rotatable portion.

12. The device as claimed in claim 1, wherein the device is, in the assembled state, mirror-symmetrical to a plane extending in a middle of the device and extending vertically to a longitudinal middle axis of the device.

13. The device as claimed in claim 8 wherein an outermost line of the web of one of the air guiding members measured in a radial direction of the curve of the web is located centrally between the two legs.

14. The device as claimed in claim 8 wherein the web forms a portion of an ellipse.

15. The device as claimed in claim 1, wherein a sensor for determining the flow speed is arranged in the region of the air guiding members.

16. A device for adjusting an air volume flow, in particular in an air distribution network, wherein the device has air guiding members which extend in a radial direction and in a state distributed about a longitudinal center axis of the device, wherein between adjacent air guiding members there are formed air passages, and wherein the air passages can be adjusted in terms of their opening cross section, wherein at least some of the air guiding members are formed from a first and a second air guiding unit, wherein the first air guiding unit can be rotated relative to the second air guiding unit about the longitudinal center axis of the device, wherein, by rotating the first air guiding unit relative to the second air guiding unit, the opening cross section of the air passages can be changed and wherein the air guiding member formed by the first and the second air guiding unit has a closed and curved surface at least at the inflow side, wherein the first air guiding unit has a hook-like cross section with a short leg, a long leg and a rounded curved portion, wherein the second air guiding unit has an L-shaped cross section with a short leg, a long leg and a rounded angular curved portion which connects the two legs and which is less than 90°, wherein the short leg of the first air guiding unit is located on the short leg of the second air guiding unit and it can be displaced when rotated relative thereto, whereby the spacing from an adjacent air guiding member changes.

17. The device as claimed in claim 16, wherein the first air guiding unit can be rotated relative to the second air guiding unit in such a manner that a smallest opening cross section in each relative rotation position of the first air guiding unit remains at the same location relative to the longitudinal center axis of the device.

18. The device as claimed in claim 16, wherein all the first air guiding units can be rotated together with each other relative to the second air guiding units thereof.

19. The device as claimed in claim 16, wherein all the air guiding members are formed from a first and a second air guiding unit.

20. The device as claimed in claim 16, wherein all the air guiding members have the same outer shape and same outer dimensions.

21. The device as claimed in claim 16, wherein the air guiding members are arranged in a rotationally symmetrical manner about the longitudinal center axis of the device.

22. The device as claimed in claim 16, wherein the air guiding members are arranged radially about an ellipsoid central projection.

23. A device for adjusting an air volume flow, in particular in an air distribution network, wherein the device has air guiding members which extend in a radial direction and in a state distributed about a longitudinal center axis of the device, wherein between adjacent air guiding members there are formed air passages, and wherein the air passages can be adjusted in terms of their opening cross section, wherein at least some of the air guiding members are formed from a first and a second air guiding unit, wherein the first air guiding unit can be rotated relative to the second air guiding unit about the longitudinal center axis of the device, wherein, by rotating the first air guiding unit relative to the second air guiding unit, the opening cross section of the air passages can be changed and wherein the air guiding member formed by the first and the second air guiding unit has a closed and curved surface at least at the inflow side, wherein a sensor for determining the flow speed is arranged in the region of the air guiding members.

24. The device as claimed in claim 23, wherein the first air guiding unit can be rotated relative to the second air guiding unit in such a manner that a smallest opening cross section in each relative rotation position of the first air guiding unit remains at the same location relative to the longitudinal center axis of the device.

25. The device as claimed in claim 23, wherein all the first air guiding units can be rotated together with each other relative to the second air guiding units thereof.

26. The device as claimed in claim 23, wherein all the air guiding members are formed from a first and a second air guiding unit.

27. The device as claimed in claim 23, wherein all the air guiding members have the same outer shape and same outer dimensions.

28. The device as claimed in claim 23, wherein the air guiding members are arranged in a rotationally symmetrical manner about the longitudinal center axis of the device.

29. The device as claimed in claim 23, wherein the air guiding members are arranged radially about an ellipsoid central projection.

30. The device as claimed in claim 16, wherein a sensor for determining the flow speed is arranged in the region of the air guiding members.

* * * * *